US008863761B2

(12) United States Patent
Wang

(10) Patent No.: US 8,863,761 B2
(45) Date of Patent: Oct. 21, 2014

(54) CLIPPING DEVICE

(71) Applicant: Yumark Enterprises Corp., Taipei (TW)

(72) Inventor: Wen-Hsien Wang, Chiayi County (TW)

(73) Assignee: Yumark Enterprises Corp., Taipei (TW)

( * ) Notice: Subject to any disclaimer, the term of this patent is extended or adjusted under 35 U.S.C. 154(b) by 24 days.

(21) Appl. No.: 13/754,944

(22) Filed: Jan. 31, 2013

(65) Prior Publication Data

US 2014/0209117 A1 Jul. 31, 2014

(51) Int. Cl.

*A45D 8/20* (2006.01)
*A45D 8/24* (2006.01)
*A45D 8/30* (2006.01)

(52) U.S. Cl.

CPC .. *A45D 8/20* (2013.01); *A45D 8/24* (2013.01); *A45D 8/30* (2013.01)
USPC ..... 132/277; 132/276; 132/279

(58) Field of Classification Search

CPC combination set(s) only.
See application file for complete search history.

(56) References Cited

U.S. PATENT DOCUMENTS

| | | | | |
|---|---|---|---|---|
| 8,087,416 | B2 * | 1/2012 | Defenbaugh et al. | 132/277 |
| 2005/0087206 | A1 * | 4/2005 | Shyu | 132/277 |
| 2008/0149128 | A1 * | 6/2008 | Yang | 132/275 |
| 2010/0139687 | A1 * | 6/2010 | Hsu | 132/277 |

* cited by examiner

*Primary Examiner* — Robyn Doan
(74) *Attorney, Agent, or Firm* — Li & Cai Intellectual Property (USA) Office

(57) ABSTRACT

A clipping device includes a first clip jaw, a second clip jaw and a spring unit. Each clip jaw has a retaining seat, a restricting slab, and a crevice formed between these. An edge surface of the retaining seat extends to form a flange. The spring unit is disposed in the retaining seats of the first clip jaw and the second clip jaw. The flange of the first clip jaw is movably disposed in the crevice of the second clip jaw, and the flange of the second clip jaw is movably disposed in the crevice of the first clip jaw. The flanges and crevices restrict the motion between the first clip jaw and the second clip jaw, such that the clipping device of the present disclosure does not need a traditional fixture shaft and encloses the spring unit within the first clip jaw and the second clip jaw.

9 Claims, 6 Drawing Sheets

CLIPPING DEVICE

BACKGROUND OF THE INVENTION

1. Field of the Invention

The present invention relates to a clipping device; in particular, to a mechanical clipping device involving a hidden spring, applicable on hair clips, grips for machine tools, fixtures, etc.

2. Description of Related Art

Hair clips are often used by people to arrange hair or to improve appearances, and conventional hair clips use torsion springs to provide gripping force. A conventional hair clip fixes two clips on a shaft, and disposes the torsion spring in an exposed position with the shaft passing through it. The disadvantage of this arrangement is that an exposed torsion spring is subject to oxidation, and hair can be tangled in the spring. When the user attempts to remove the hair clip, the spring pulls on the hair, thereby not only damaging the hair but also causing pain for the user.

In other hair clips, the two clips respectively have an engagement base and a seat base which are different in shape. The spring is disposed at the engagement base, and the shaft is disposed to pass through the seat base and the spring to fix the two clips. The conformity between the shapes of the engagement base and the seat base hides the spring between the two clips. The disadvantage of this arrangement is that even though the spring is hidden, the shaft is still partially exposed and subject to oxidation. Moreover, the need for differently shaped bases which conform to each other increases the cost of the molds and the time for assembly.

Therefore, the inventor believes the above mentioned structures can be improved upon, and through many years of experience, careful observation and research, combined with application of theory, has proposed the present disclosure which reasonably and effectively improves upon the above mentioned deficiencies.

SUMMARY OF THE INVENTION

The object of the present disclosure is to provide a clipping device, whose spring unit is hidden between the first clip jaw and the second clip jaw and whose assembly does not require a shaft. The spring unit is hidden and protected from oxidation. Additionally, the first and second clip jaws have the same shape, thereby reducing the mold cost and assembly time.

In order to achieve the aforementioned objects, the present disclosure provides a clipping device, which includes a first clip jaw, a second clip jaw and a spring unit. The first clip jaw and the second clip jaw each include a pressing portion, a jaw portion, a retaining seat disposed between the pressing portion and the jaw portion, and a restricting slab disposed next to the retaining seat. One side of the retaining seat is indented to form a molded cavity, and one edge surface of the retaining seat extends to form a flange. The spring unit is disposed in the mold cavities of the first clip jaw and the second clip jaw. The flange of the first clip jaw is movably disposed in the crevice of the second clip jaw. The flange of the second clip jaw is movably disposed in the crevice of the first clip jaw. The flanges and the crevices are used to restrict the motion between the first clip jaw and the second clip jaw. The spring unit is accommodated within the mold cavities, replacing the traditional fixing shaft.

According to an embodiment of the present disclosure, the jaw portion has multiple teeth structures with specific gaps between them for clipping hair therein without slipping.

In order to further the understanding regarding the present disclosure, the following embodiments are provided along with illustrations to facilitate the disclosure of the present disclosure but are not intended to define the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
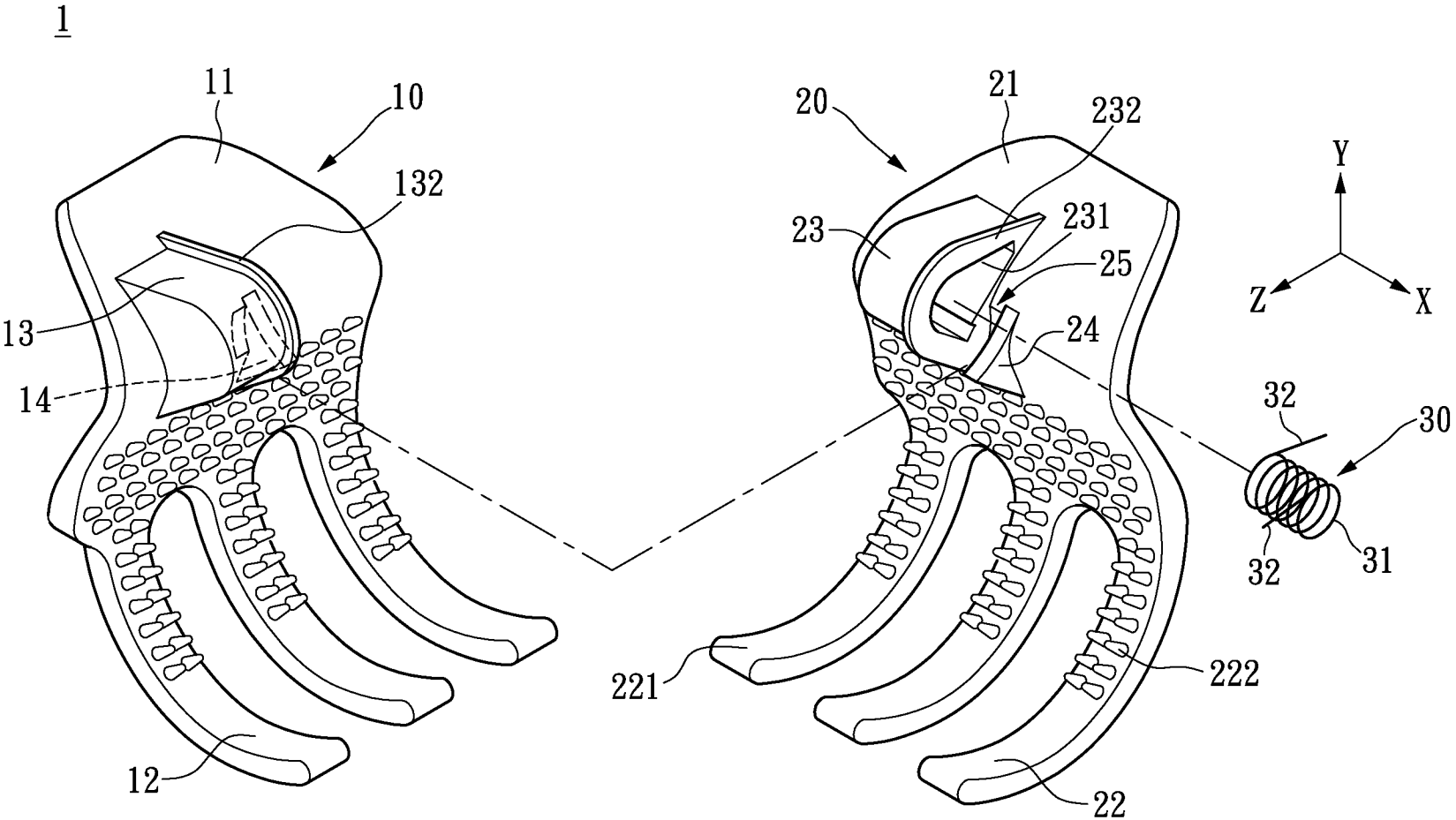
FIG. 1 shows an exploded schematic diagram of a clipping device of the present disclosure.

Referring to FIG. 1, the present disclosure provides a clipping device 1, which has a first clip jaw 10, a second clip jaw 20, and a spring unit 30. The spring unit 30 is disposed between the first clip jaw 10 and the second clip jaw 20. The figures and their components are described in the following.

Figure 2:
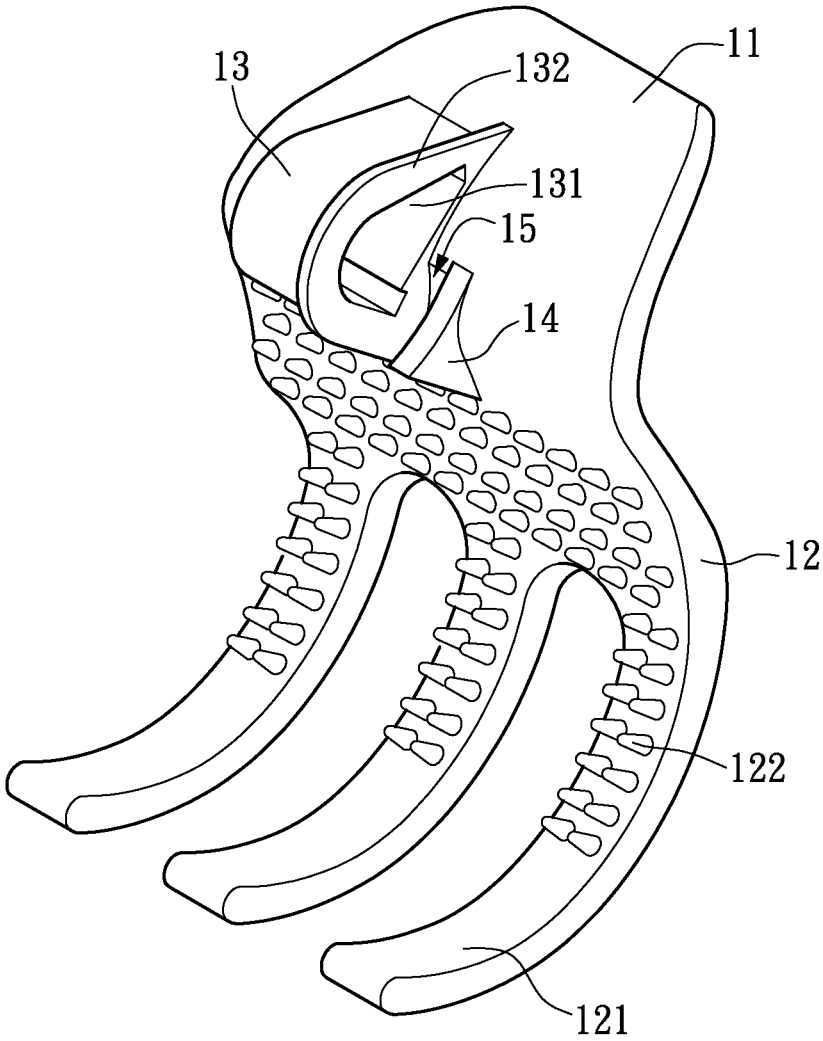
FIG. 2 shows a schematic diagram of a first clip jaw of a clipping device of the present disclosure.

Referring to FIG. 2, one special feature of the present disclosure lies in the use of a pair of substantially symmetrically structured first clip jaw 10 and the second clip jaw 20, therefore eliminating the need for different molds and reducing the cost of manufacturing. The present figure describes the first clip jaw 10, which is essentially the same as the second clip jaw 20. The first clip jaw 10 has a pressing portion 11, a jaw portion 12, a retaining seat 13 and a restricting slab 14. Specifically, the pressing portion 11 is positioned at one end of the first clip jaw 10. The pressing portion 11 can be a curved slab for users to press on but is not limited thereto. The jaw portion 12 is positioned at the other end of the first clip jaw 10 and has a comb structure 121, likewise not limited thereto.

The retaining seat 13 and the restricting slab 14 are disposed between the pressing portion 11 and the jaw portion 12. The restricting slab 14 is disposed next to the retaining seat 13, forming a crevice 15 between them. Moreover, the surface of the retaining seat 13 facing the restricting slab 14 has a molded cavity 131, whose edge extends outwards to form a flange 132. Of special note, the width of the flange 132 is roughly equal to the width of the crevice 15.

As shown in FIG. 1, the second clip jaw 20 has the same structure as the first clip jaw 10. The second clip jaw 20 has a pressing portion 21, a jaw portion 22, a retaining seat 23 and a restricting slab 24. Specifically, the pressing portion 21 is positioned at one end of the first clip jaw 20. The pressing portion 21 can be a curved slab for users to press on but is not limited thereto. The jaw portion 22 is positioned at the other end of the first clip jaw 20 and has a comb structure 221.

The retaining seat 23 and the restricting slab 24 are disposed between the pressing portion 21 and the jaw portion 22.

Figure 3:
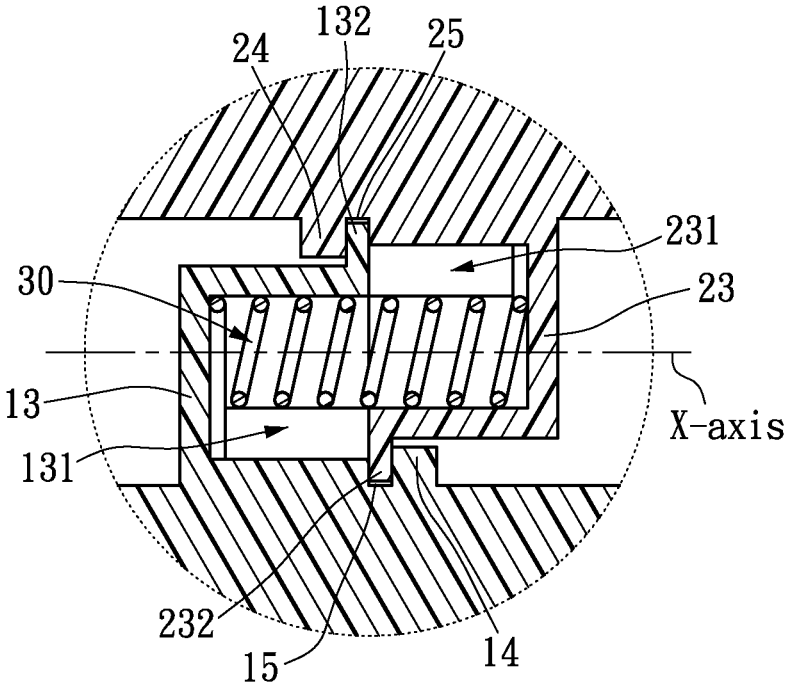
FIG. 3 shows a cross-sectional diagram of a pivotal connection section of the first clip jaw and the second clip jaw of the present disclosure.

The restricting slab 24 is disposed next to the retaining seat 23, forming a crevice 25 between them (as shown in FIG. 3). Moreover, the surface of the retaining seat 23 facing the restricting slab 24 has a molded cavity 231, whose edge extends outwards to form a flange 232. Of special note, the width of the flange 232 is roughly equal to the width of the crevice 25.

As shown in FIG. 1, the spring unit 30 is a torsion (or torque) spring, which has a spiral tube 31 and a pair of resistance feet 32 extending tangentially from the spiral tube 31. The present embodiment defines the direction of the axis of the spiral tube 31 to be the x-axis, the direction the resistance feet 32 rest at while under no stress to be the z-axis, and the direction perpendicular to the x-axis and the z-axis to be the y-axis.

As shown in FIG. 1, FIG. 2, and FIG. 3, the retaining seat 13 of the first clip jaw 10 and the retaining seat 23 of the second clip jaw 20 are adjacent and parallel to each other, and the molded cavity 131 and the molded cavity 231 face each other. The spring unit 30 is partially accommodated inside the molded cavity 131 of the first clip jaw 10, and partially accommodated inside the molded cavity 231 of the second clip jaw 20. Namely, the spring unit 30 is completely accommodated within the first clip jaw 10 and the second clip jaw 20 without being exposed. Preferably, the elastic/spring unit 30 has adequate linear structural strength in the axle direction. With this arrangement, the elastic unit 30 can not only function as a torsional biasing device for urging the closure of the clip jaws 10/20, it can also serve as a pivotal shaft for the clip, thereby eliminating the need for having a pivot shaft/pin commonly found in the conventional clips. This structure prevents oxidation, loss of elasticity and fracturing of the spring unit 30 due to exposure. Additionally, when this structure is applied on a hair clip, the hair is prevented from tangling with the spring unit 30.

Figure 4:
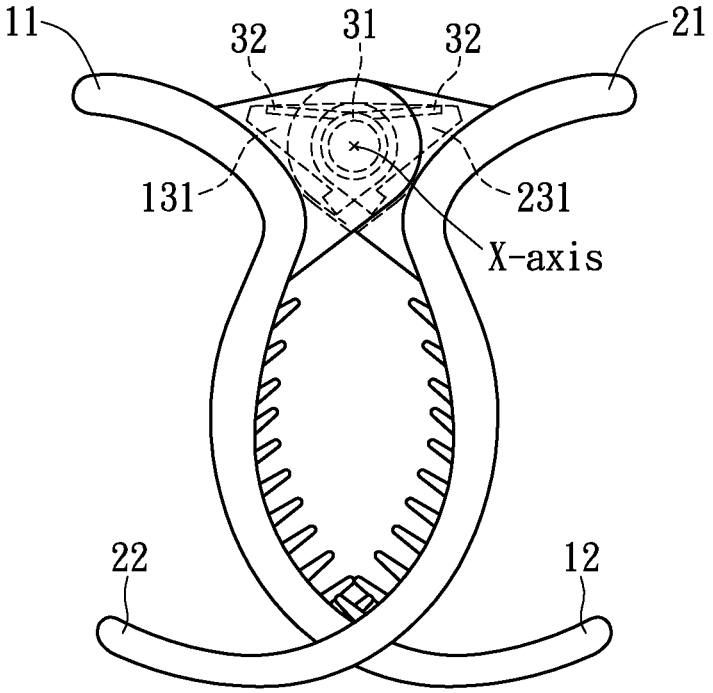
FIG. 4 is a schematic diagram of the clipping device of the present disclosure in a completely closed position.
Figure 5:
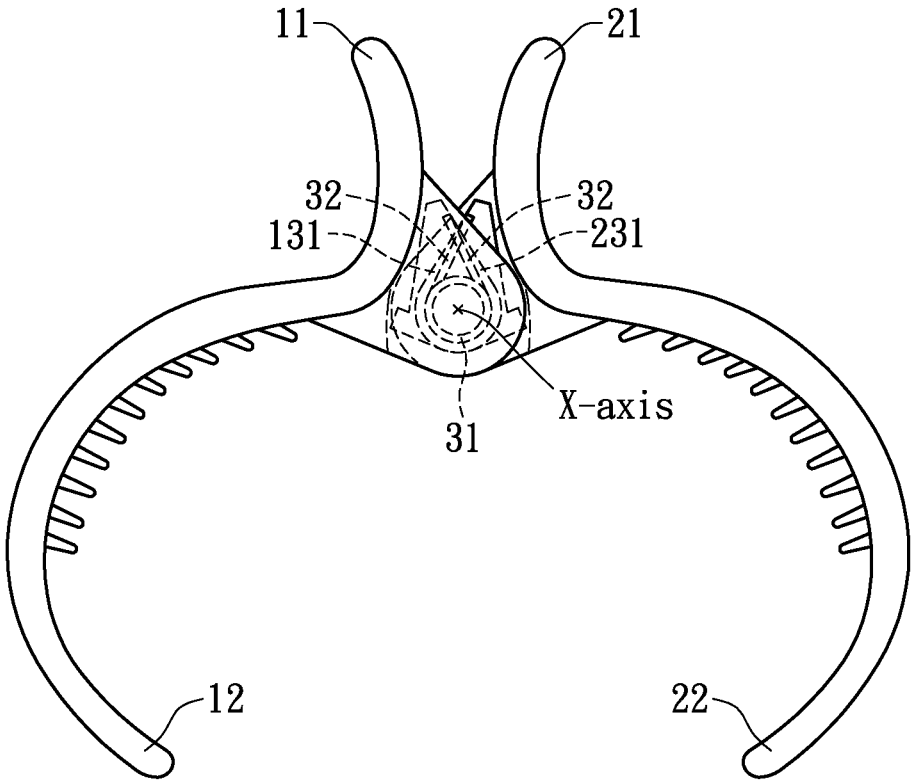
FIG. 5 is a schematic diagram of the clipping device of the present disclosure in a completely open position.

As shown in FIG. 4 and FIG. 5, at the Y-Z plane, namely the plane facing the mold cavities 131 and 231, the mold cavities 131 and 231 are roughly water drop-shaped, such that the resistance feet 32 can be respectively accommodated at the narrower portions of the mold cavities 131 and 231, in contact with and applying forces on the walls thereat. However, the shape of the mold cavities 131 and 231 is not limited to a water drop, and can be for example triangular.

Referring to FIG. 4, the clipping device 1 of the present disclosure is presented in a completely closed position. Referring to FIG. 5, the clipping device 1 is presented in a completely open position. When the clipping device 1 is in the completely closed position (as shown in FIG. 4), the overlapping portion at the Y-Z plane between the molded cavity 131 and the molded cavity 231 is roughly the same as the cross-sectional area of the spiral tube 31, and the two resistance feet 32 generally do not overlap. The two pressing portions 11 and 21 are relatively far apart. The two jaw portions 12 and 22 are relatively close, even interlacing.

As shown in FIG. 5, when the clipping device 1 is in the above completely open position, the molded cavity 131 and the molded cavity 231 roughly overlap each other completely at the Y-Z plane. The clipping device 1 can be at any position between the completely closed position and the completely open position.

When the clipping device 1 moves from the completely closed position to the completely open position, the overlapping portion between the molded cavity 131 and the molded cavity 231 at the Y-Z plane changes from being equivalent to the cross-sectional area of the spiral tube 31 to roughly completely overlapping. The two pressing portions 11 and 21 rotate about the axis of the spring unit 30 and move closer to each other. The two jaw portions 12 and 22 also rotate about the axis of the elastic unit 30 and move (from an interlacing position) further from each other.

When the user does not apply force on the pressing portion 11 of the first clip jaw 10 and the pressing portion 21 of the second clip jaw 20, the clipping device 1 is at the completely closed position. When the user applies force on the pressing portions 10 and 11, the clipping device 1 moves from the completely closed position to the completely open position, and the resistance feet 32 applies an increasingly larger force on the walls of the mold cavities 131 and 231, so that the user has to apply an increasingly larger force in order to move the clipping device 1 to the completely open position.

As shown in FIG. 3, the flange 132 of the first clip jaw 10 is movably disposed at the crevice 25 of the second clip jaw 20. The flange 132 fits between the restricting slab 24 and the retaining seat 23 of the second clip jaw 20, such that the flange 132 cannot move in the direction of the x-axis. The flange 232 of the second clip jaw 20 is movably disposed at the crevice 15 of the first clip jaw 10. The flange 232 fits between the restricting slab 14 and the retaining seat 13 of the first clip jaw 10, such that the flange 232 cannot move in the direction of the x-axis. The bottom surfaces of the crevices 15 and 25 are curved correspondingly to the flanges 132 and 232. With this structure, the first clip jaw 10 and the second clip jaw 20 are restricted from moving in the directions of the y-axis and the z-axis by the elastic unit 30 connected inside, and restricted from moving in the direction of the x-axis by the restricting slabs 15 and 25, such that the clipping device 1 can pivotally connect the first clip jaw 10 and the second clip jaw 20 without using a traditional fixing shaft.

The edge of the restricting slab 14 of the first clip jaw 10 movably abuts the retaining seat 23 of the second clip jaw 20, with the abutting parts correspondingly curved. Likewise, the restricting slab 24 of the second clip jaw 20 is similarly related to the retaining seat 13 of the first base 10. This structural configuration allows the clipping device 1 to successfully open and close, and prevents the flanges 132 and 232 from detaching from the crevices 15 and 25 in order to prevent separation of the first clip jaw 10 and the second clip jaw 20.

As shown in FIG. 4, the present disclosure has a preferred embodiment. The pressing portions 11 and 21 respectively extend and curve outwards from the first clip jaw 10 and the second clip jaw 20, such that a longer lever arm is between the spring unit 30 and the position the user applies pressing force on. The jaw portions 12 and 22 respectively extend and curve inwards from the first clip jaw 10 and the second clip jaw 20 to form comb structures 121 and 221. The comb structures 121 and 221 in the present embodiment each have three combs, but the comb number is not limited herein and can be three, four, five, six, or any number. The inward curving comb structures 121 and 221 form a clipping space. The inside surfaces of the jaw portions 12 and 22 each have multiple evenly spaced teeth structures 122 and 222. When the user applies this clipping device on a hair clip, the hair can be tightly and securely clipped between the teeth to prevent sliding.

Figure 6:
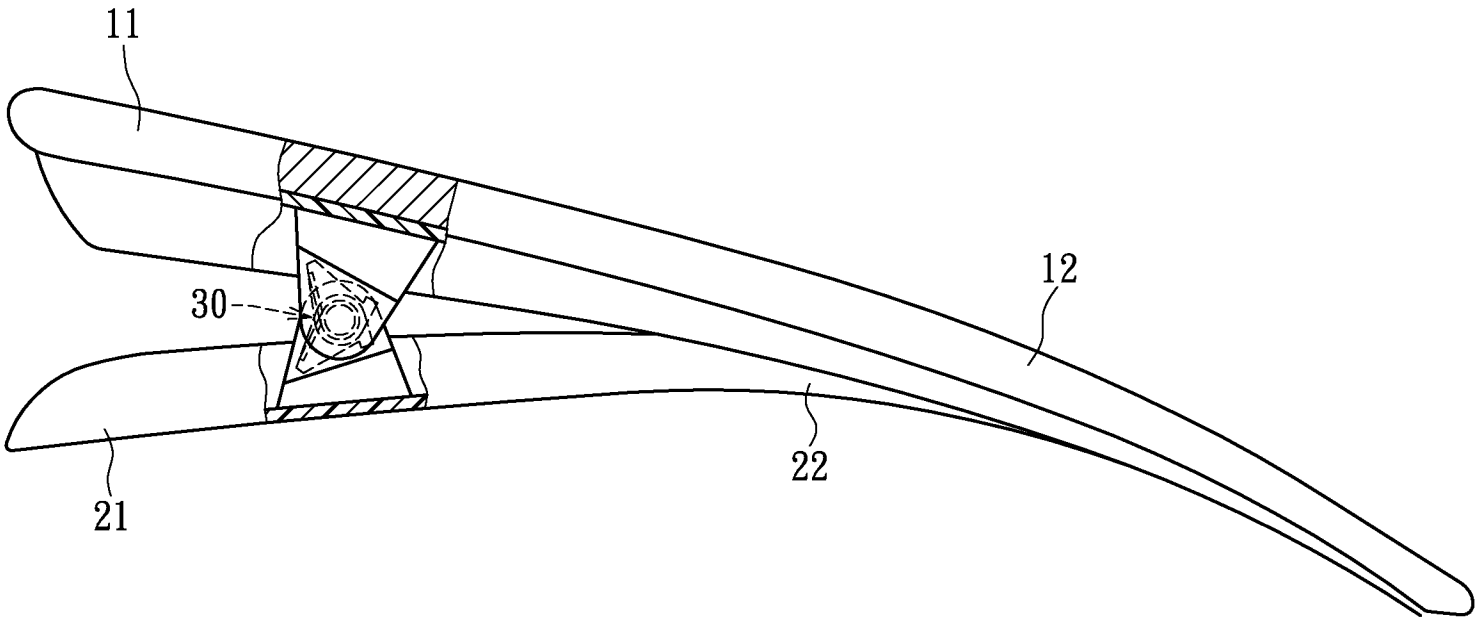
FIG. 6 is a side view schematic diagram of another embodiment of the present disclosure.

As shown in FIG. 6, the present disclosure has another preferred embodiment. The pressing portions 11 and 12 respectively extend from the first clip jaw 10 and the second clip jaw 20 in an arc shape. The shape is not limited herein and can also be concaved outward, or other aesthetic shapes such as flower shape, butterfly shape, crown shape, etc. The jaw portions 12 and 22 respectively extend from the other ends of the first clip jaw 10 and the second clip jaw 20 in an elongated arc shape. The jaw portion 12 of the first clip jaw can have multiple teeth structures (not shown in the figure) on its interior surface, such that hair can be clipped thereat to prevent sliding.

The application of clipping device 1 is not limited herein. The clipping device 1 can also be applied on any machine tools which use a torsion spring for gripping. For example on machine tools or processing machines, the clipping device can be used as grip in work pieces, cutting tools, dolls, fixture devices, etc.

In summary of the above, the present disclosure has the following advantages:

1. The retaining seats of the first clip jaw and the second clip jaw completely enclose the spring unit, thereby preventing tangling of hair with the spring unit and oxidation of the spring unit.

2. The configuration of the restricting slabs, crevices and flanges restricts the movement between the first clip jaw and the second clip jaw, such that the clipping device does not need a traditional shaft for providing fixture.

3. The abutting parts between the restricting slabs and the retaining seats are correspondingly arc shaped, such that the closing and opening process of the clipping device is more fluid.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A clipping device, comprising:

a pair of substantially symmetrically structured first clip jaw and a second clip jaw pivotally coupleable with each other in a face to face manner, each having a pressing portion arranged on a rear end thereof, a jaw portion arranged on a front end thereof, a retaining seat arranged on an inner facing side thereof, and a restricting slab disposed adjacent to the retaining seat, wherein the retaining seat has a cavity formed therein with an opening facing the restricting slab, wherein the retaining seat comprises an outwardly extending flange surroundingly formed around the opening of the cavity proximate the restricting slab, wherein a crevice is defined between the retaining seat and the restricting slab, wherein the flange of the first clip jaw is pivotably receivable in the crevice of the second clip jaw, and the flange of the second clip jaw is pivotably receivable in the crevice of the first clip jaw; and an elastic unit having an axial direction torsionally received in the cavities and serving as a pivotal shaft, wherein a part of the elastic unit is received in the cavity of the first clip jaw and the other part of the elastic unit is received within the cavity of the second clip jaw;

whereby the first clip jaw and the second clip jaw is rotatable about the axial direction.

2. The clipping device according to claim 1, wherein the flange is arc shaped, the bottom surface of the crevice is arc shaped correspondingly to the flange, and the width of the flange is approximately equal to the width of the crevice.

3. The clipping device according to claim 1, wherein the restricting slab of the first clip jaw movably abuts the retaining seat of the second clip jaw, and the restricting slab of the second clip jaw movably abuts the retaining seat of the first clip jaw.

4. The clipping device according to claim 3, wherein the abutting parts of the restricting slab and the retaining seat have a corresponding arc shape.

5. The clipping device according to claim 1, wherein the elastic unit has a spiral tube and resistance feet tangentially extending from the two ends of the spiral tube.

6. The clipping device according to claim 1, wherein the cavity is water drop-shaped, and the resistance feet movably abuts narrow portions of the cavities.

7. The clipping device according to claim 1, wherein the pressing portions are extensions from the ends of the first clip jaw and the second clip jaw curving outwards, the jaw portions are extensions from the other ends of the first clip jaw and the second clip jaw to form comb structures, and the jaw portions curve inwards.

8. The clipping device according to claim 1, wherein the pressing portions are extensions from the ends of the first clip jaw and the second clip jaw to form an arc shape, the jaw portions are extensions from the other ends of the first clip jaw and the second clip jaw to form an elongated arc shape, and the two sides of the jaw portions have multiple teeth structures.

9. The clipping device according to claim 1, wherein each of the jaw portions of the first clip jaw and the second clip jaw has multiple teeth structures.

* * * * *